US006556812B1

(12) United States Patent
Pennanen et al.

(10) Patent No.: US 6,556,812 B1
(45) Date of Patent: Apr. 29, 2003

(54) ANTENNA COUPLER AND ARRANGEMENT FOR COUPLING A RADIO TELECOMMUNICATION DEVICE TO EXTERNAL APPARATUSES

(75) Inventors: Jouni Pennanen, Salo (FI); Ilkka Pankinaho, Paimio (FI); Mika J. Tuominen, Paimio (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/433,166

(22) Filed: Nov. 3, 1999

(30) Foreign Application Priority Data

Nov. 4, 1998 (FI) ..... 982389

(51) Int. Cl.[7] ..... H04D 1/38
(52) U.S. Cl. ..... 455/90; 343/702; 343/906
(58) Field of Search ..... 455/550, 575, 455/90, 129, 95, 97, 346; 343/702, 703, 700, 906, 841, 895; D14/230

(56) References Cited

U.S. PATENT DOCUMENTS

| | | | | | |
|---|---|---|---|---|---|
| 4,031,468 | A | * | 6/1977 | Ziebell et al. | 455/346 |
| 4,661,992 | A | * | 4/1987 | Garay et al. | 455/575 |
| 5,053,786 | A | * | 10/1991 | Silverman et al. | 343/895 |
| 5,203,021 | A | * | 4/1993 | Repplinger et al. | 455/90 |
| 5,357,262 | A | * | 10/1994 | Blaese | 343/906 |
| 5,394,162 | A | * | 2/1995 | Korovesis et al. | 343/703 |
| 5,649,316 | A | * | 7/1997 | Prodhomme et al. | 455/345 |
| 5,822,705 | A | * | 10/1998 | Lehtola | 455/575 |
| 5,929,813 | A | * | 7/1999 | Eggleston | 343/700 |
| 5,986,606 | A | * | 11/1999 | Kossiavas et al. | 343/700 |
| 5,999,132 | A | * | 12/1999 | Kitchener et al. | 343/702 |
| 6,005,529 | A | * | 12/1999 | Hutchinson | 343/797 |
| 6,031,496 | A | * | 2/2000 | Kuittinen et al. | 343/702 |
| 6,043,780 | A | * | 3/2000 | Funk et al. | 343/702 |
| 6,091,363 | A | * | 7/2000 | Komatsu et al. | 343/700 |
| 6,112,108 | A | * | 8/2000 | Crowley et al. | 455/575 |
| 6,134,421 | A | * | 10/2000 | Lee et al. | 455/90 |
| 6,157,819 | A | * | 12/2000 | Vuokko et al. | 455/90 |
| 6,377,827 | B1 | * | 4/2002 | Rydbeck | 455/575 |

FOREIGN PATENT DOCUMENTS

| | | | |
|---|---|---|---|
| EP | 0 399 975 | | 11/1990 |
| EP | 0751043 | A1 | 1/1997 |
| EP | 0 766 339 | | 4/1997 |
| EP | 0 892 459 | | 1/1999 |
| GB | 2266997 | * | 11/1993 |
| WO | WO 98/01919 | * | 1/1998 |

OTHER PUBLICATIONS

"Dual Band Antenna for Hand Held Portable Telephones", Liu et al., Electronics Letters, vol. 32, No. 7, 1996, pp. 609–610.

* cited by examiner

*Primary Examiner*—Dwayne Bost
*Assistant Examiner*—Joy K. Contee

(57) ABSTRACT

An antenna coupler (400, 500, 802) is provided for coupling a radio telecommunication device (301) with an integral planar antenna to an external device (801). The integral planar antenna of the radio telecommunication device comprises a first planar conductive antenna element (306). The antenna coupler comprises a second planar conductive antenna element (401, 501) which is essentially similar to the first planar conductive antenna element, a first conductive ground plane (403) parallel to the second planar conductive antenna element and transmission apparatus (404) for conducting a radio frequency signal between the second planar conductive antenna element and the external device.

18 Claims, 8 Drawing Sheets

ANTENNA COUPLER AND ARRANGEMENT FOR COUPLING A RADIO TELECOMMUNICATION DEVICE TO EXTERNAL APPARATUSES

TECHNOLOGICAL FIELD

The invention concerns generally the technology of coupling a radio telecommunication device to some external apparatus like an external antenna or a testing arrangement. Especially the invention concerns solutions with non-galvanic coupling to the radio telecommunication device. A portable radio telephone or a mobile telephone is used as an examplary radio telecommunication device, but the invention is equally applicable in connection with other kinds of radio telecommunication devices like pagers, portable data terminals, positioning devices and so on.

BACKGROUND OF THE INVENTION

Arranging communication connections between a radio telecommunication device and the external world necessitates in the former an antenna for receiving and transmitting electromagnetic radiation at a predetermined frequency band. In mobile telephone systems the telephone communicates through its antenna with a base station located somewhere at a maximum distance of some tens of kilometres from the telephone. However, in some situations it is preferable to temporarily arrange the communication connections of the radio telephone differently. Typical such cases are the use of the radio telephone together with a vehicle kit including an external antenna, coupling the radio telephone to some other kind of booster kit for establishing a wider coverage area, or coupling the radio telephone to a testing arrangement for measuring its performance either at the production line or during service.

A widely accepted solution for the above-mentioned special occasions is to have a galvanically coupled pair of radio frequency connectors, of which one is located in the telephone and the other is at the end of a coaxial cable or similar coupling means for conducting the radio frequency signal to the external equipment. Building a radio frequency connector into a radio telephone reserves space from inside the device and increases manufacturing costs, which are serious drawbacks because the industry is continuously striving to make especially handportable mobile telephones smaller and cheaper. There is also a danger of the galvanic connectors becoming dirty, corroded and/or misaligned even in the course of normal use, which weakens the quality of the achieved connection.

The European published patent application number EP 0 399 975 discloses a solution for coupling a mobile telephone to the cable of an external antenna with no galvanic connections. The solution is based on a pair of capacitive plates, one of which is located inside the dielectric cover of a mobile telephone and the other in a holder for holding the mobile telephone during use inside a car. When the mobile telephone is in its holder, the capacitive plates come near each other in a parallel configuration and form a coupling capacitor for the radio frequency signal to pass through. A separate switch is used to couple either the internal antenna or the capacitive plate to the transmit and receive ports of the transceiver in the mobile telephone. The performance characteristics of this solution are not very good, and the switch takes also space from inside the mobile telephone and increases manufacturing costs.

From the British published patent application number GB 2 266 997 there is known a structure like the one in FIG. 1.

The mobile telephone 101 comprises a protruding antenna 102 and a dielectric outer cover 103. A cable 104 to an external antenna (not shown) comprises at its one end a coupler 105 which can be fastened to the outer cover of the mobile telephone by means of a Velcro tape or other disconnectable fastening means. A resonator 106 is located inside the coupler 105. When the coupler is connected to the mobile telephone, the resonator 106 lies within the electromagnetic field of the antenna 102 and mediates an electromagnetic coupling between the antenna 102 and the external antenna cable 104. The drawback of this structure is the pronounced dependency of the coupling characteristics on the mutual position of the antenna 102 and the resonator 106. Even a small change in the fastening position of the coupler 105 will dramatically change the coupling coefficient that describes the relative amount of electromagnetic energy transferred between the antenna and the resonator. In practice it is very difficult to align the coupler perfectly each time in a series of repeated connecting and disconnecting.

The European patent application with serial number 96660046.2 discloses a structure like that in FIGS. 2*a* and 2*b*. Here again no superfluous connectors or switches are needed, because the radio frequency signal is coupled between the protruding antenna 201 and the nearby resonator element 202 by electromagnetic coupling. A tuning element 203 and a ground connection 204 serve to enhance the quality of the connection. The drawbacks of the solution of FIG. 2 are that it is somewhat cumbersome in use and it requires the mobile telephone to have a protruding antenna.

SUMMARY OF THE INVENTION

The object of the present invention is to present an antenna coupler for coupling a radio telecommunication device to an external apparatus without the characteristic drawbacks of the prior art solutions. Especially it is an object of the invention to provide an antenna coupler that is easy to use and effective in the sense that a relatively small portion of the electromagnetic energy involved is wasted into unwantedly diffused radiation. A further object of the invention is to provide an antenna coupler with which it is easy to achieve an essentially identical connection of good quality even in repeated occasions of coupling and decoupling.

The objects of the invention are achieved by providing, for radio telecommunication devices with planar integral antennae, an antenna coupler with at least one antenna element which is similar to an antenna element in the radio telecommunication device. To further comply with the objects of the invention, the antenna coupler may be embedded into a holder for the radio telecommunication device.

The antenna coupler according to the invention is characterised in that it comprises

- a second planar conductive antenna element which is essentially similar to a first planar conductive antenna element in the radio telecommunication device,
- a first conductive ground plane parallel to said second planar conductive antenna element and
- transmission means for conducting a radio frequency signal between said second planar conductive antenna element and an external device.

The invention applies equally to an arrangement for coupling a radio telecommunication device to an external apparatus. The arrangement according to the invention is characterised in that it comprises in an antenna coupler the abovementioned features.

A planar integral antenna is a relatively novel antenna structure for radio telecommunication devices, especially handportable mobile telephones. It comprises an essentially planar conductive antenna element with carefully designed outline and dimensions. There are one or several feedpoints for coupling the antenna element to the antenna port of a radio transceiver, and a ground plane somewhere in the close vicinity of the antenna element. According to the invention an essentially similar antenna element is provided in an antenna coupler. Additionally the antenna coupler comprises a ground plane. The antenna element in the antenna coupled is further coupled to a coaxial cable or other signal conducting means for conducting a signal in the transmission direction to some external device and/or a signal in the reception direction from some external device. Such an external device may be for example an external antenna belonging to a vehicle kit or a testing arrangement for measuring the performance of the radio telecommunication device during manufacture or service.

The dimensioning and mutual placement of the antenna element and the ground plane in the antenna coupler can be used in a way described in more detail below to tune the performance characteristics of the antenna coupler into some required direction. In a variation of the invention the radio telecommunication device comprises several differently sized planar integral antenna elements, in which case it is possible to use an antenna coupler with an equal number of equally sized planar antenna elements. The invention is not limiting in this aspect: for a radio telecommunication device with only one antenna element it is possible to use an antenna coupler with several antenna elements, and vice versa.

BRIEF DESCRIPTION OF DRAWINGS

The novel features which are considered as characteristic of the invention are set forth in particular in the appended Claims. The invention itself, however, both as to its construction and its method of operation, together with additional objects and advantages thereof, will be best understood from the following description of specific embodiments when read in connection with the accompanying drawings.

FIGS. 1 and 2 were referred to in the description of prior art, so in the following we will mainly concentrate on FIGS. 3*a* to 8. Like parts are designated with same reference designators.

DETAILED DESCRIPTION OF THE INVENTION

Figure 1:
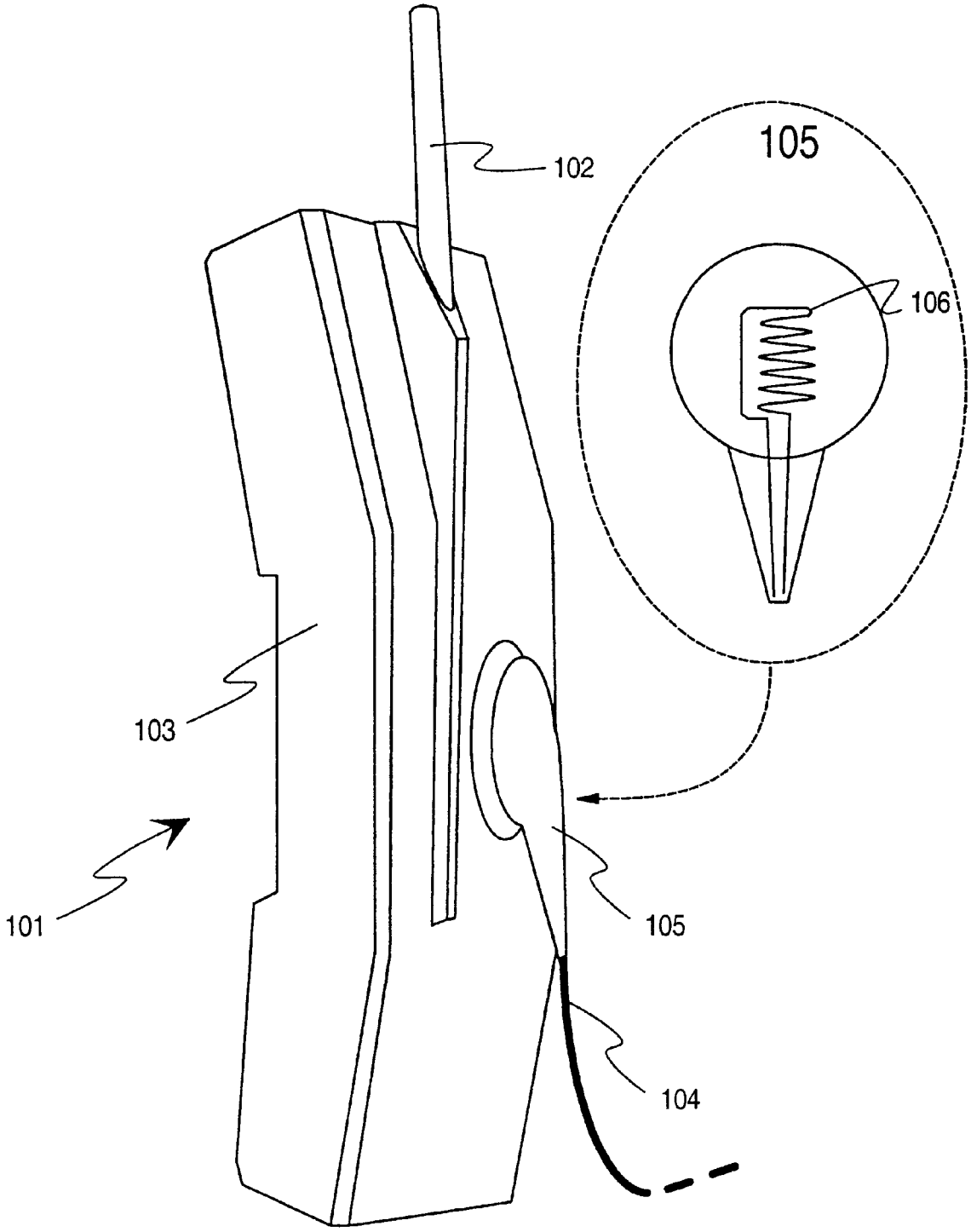
Fig. 1 PRIOR ART
FIG. 1 illustrates a first prior art antenna coupler.
Figure 2A:
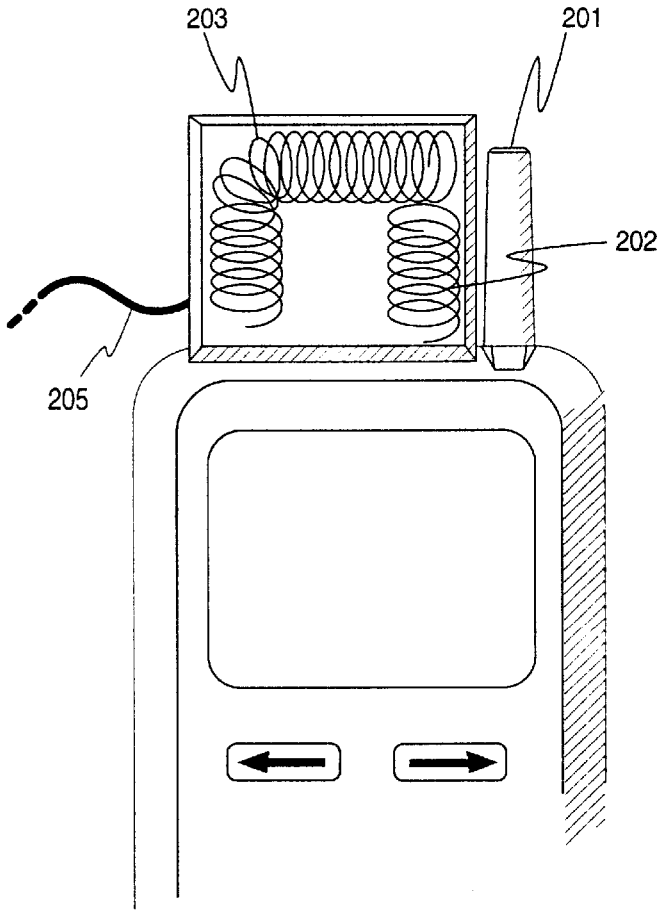
Fig. 2a PRIOR ART
FIGS. 2*a* and 2*b* illustrate a second prior art antenna coupler.
Figure 2B:
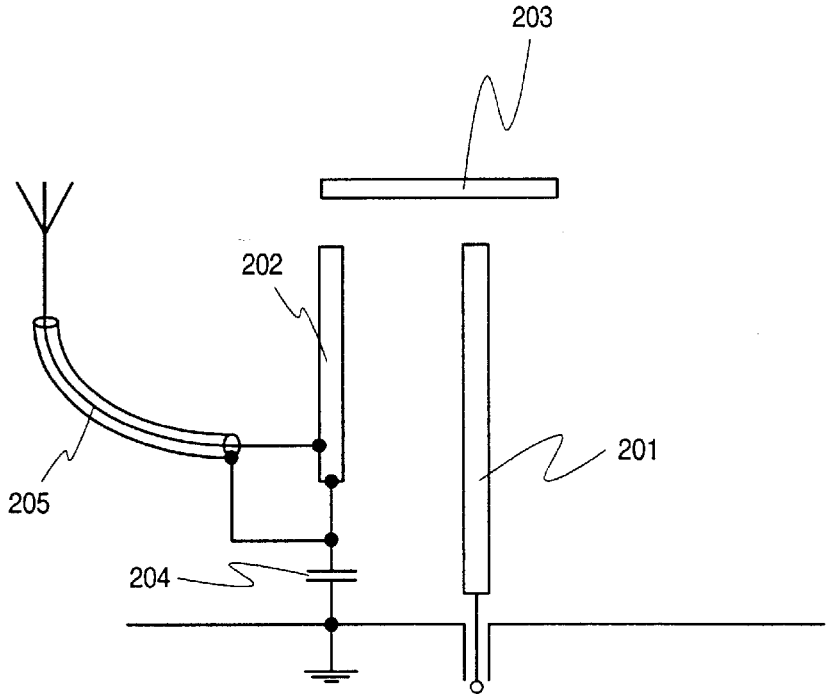
Fig. 2b PRIOR ART
Figure 3A:
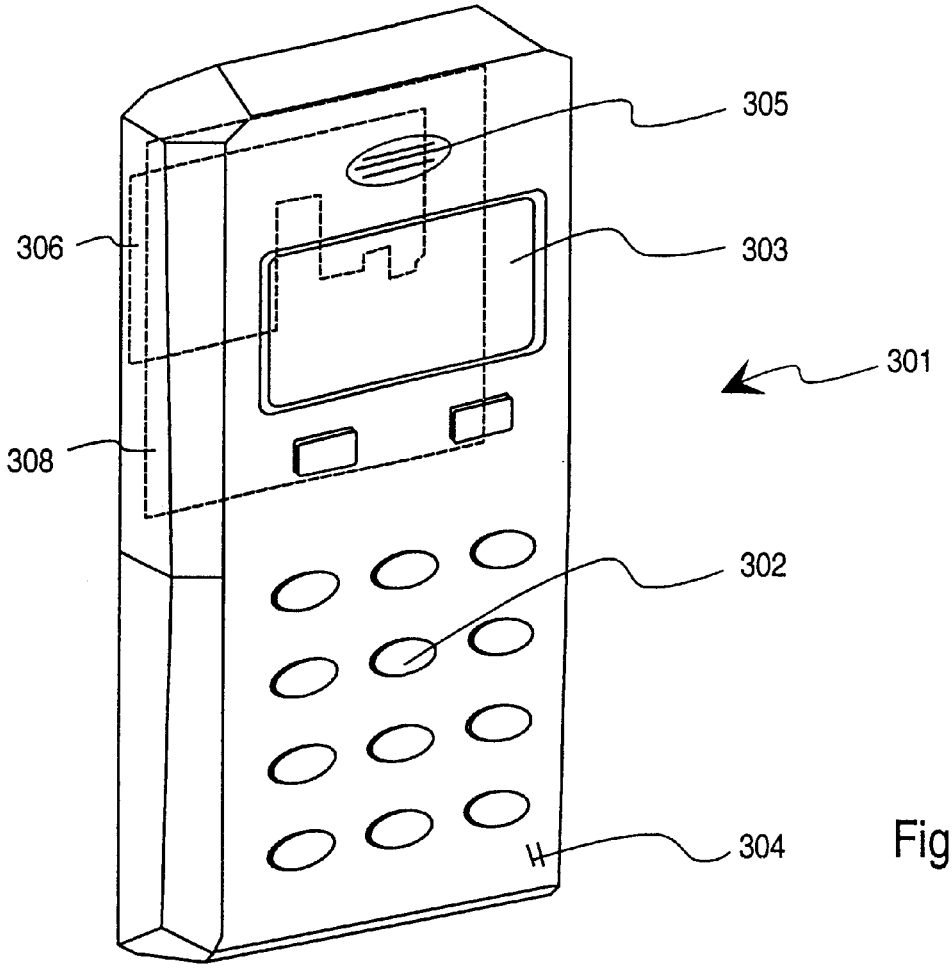
FIG. 3*a* is a schematic drawing of a mobile telephone with a planar integral antenna element.
Figure 3B:
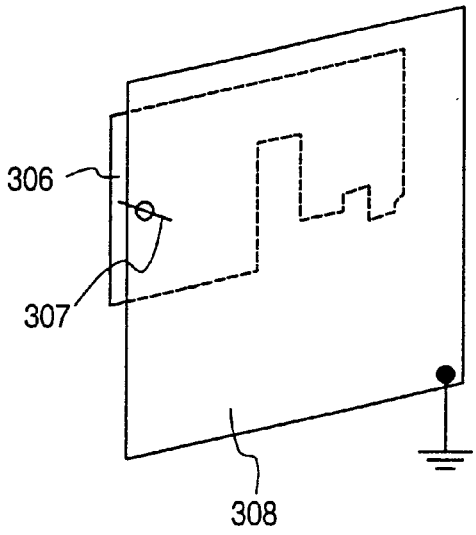
FIG. 3*b* illustrates a detail of FIG. 3*a,*

FIG. 3*a* illustrates a mobile telephone 301 with a keyboard 302, display 303, microphone 304 and loudspeaker 305 arranged on one side as is conventional in the technology of mobile telephones. The mobile telephone of FIG. 3*a* does not have a protruding helix or whip antenna like most previously known mobile telephones. Instead it comprises within its outer cover an essentially planar conductive antenna element 306, which is seen in more detail in FIG. 3*b*. Together with its feed point 307 and a ground plane 308 the conductive antenna element 306 constitutes a so-called PIFA or Planar Inverted F Antenna, which is a concept known as such in the field of antenna structures. It is typical of PIFA's that the dimensioning and outline of the planar conductive antenna element, together with the positioning of the feed point and the distance between the conductive antenna element and the ground plane are intimately connected to the electromagnetic characteristics of the antenna structure. By electromagnetic characteristics we mean factors like electrical length in relation to the wavelength on the operational frequency, location of the resonance frequency or resonance frequencies on the frequency axis, usable bandwidth around the resonance frequency or resonance frequencies, impedance at the feed point and so on. For the present invention the actual shape and size of the conductive antenna element is not important as long as it is known.

An optimal antenna for a handportable mobile telephone has basically an omnidirectional radiation pattern, i.e. it transmits and receives electromagnetic energy equally well in all directions. An exception to the optimal omnidirectionality is the direction from the antenna towards the body and head of the user in the normal operational position. Biological tissue absorbs electromagnetic radiation causing unnecessary waste of electromagnetic energy, so the radiation pattern of an antenna in a handportable mobile telephone may have a fade in that direction. Consequently, and further taking into account the conventional flat design of a handportable mobile telephone, it is most common that the conductive antenna element 306 is located next to the outer cover of the telephone on the side which is most distant from the user's head in the normal operational position and the ground plane 308 lies parallelly to the conductive antenna element so that during use it is located between the conductive antenna element and the user's head. A layer of air or some other dielectric material separates the ground plane from the conductive antenna element.

Figure 4:
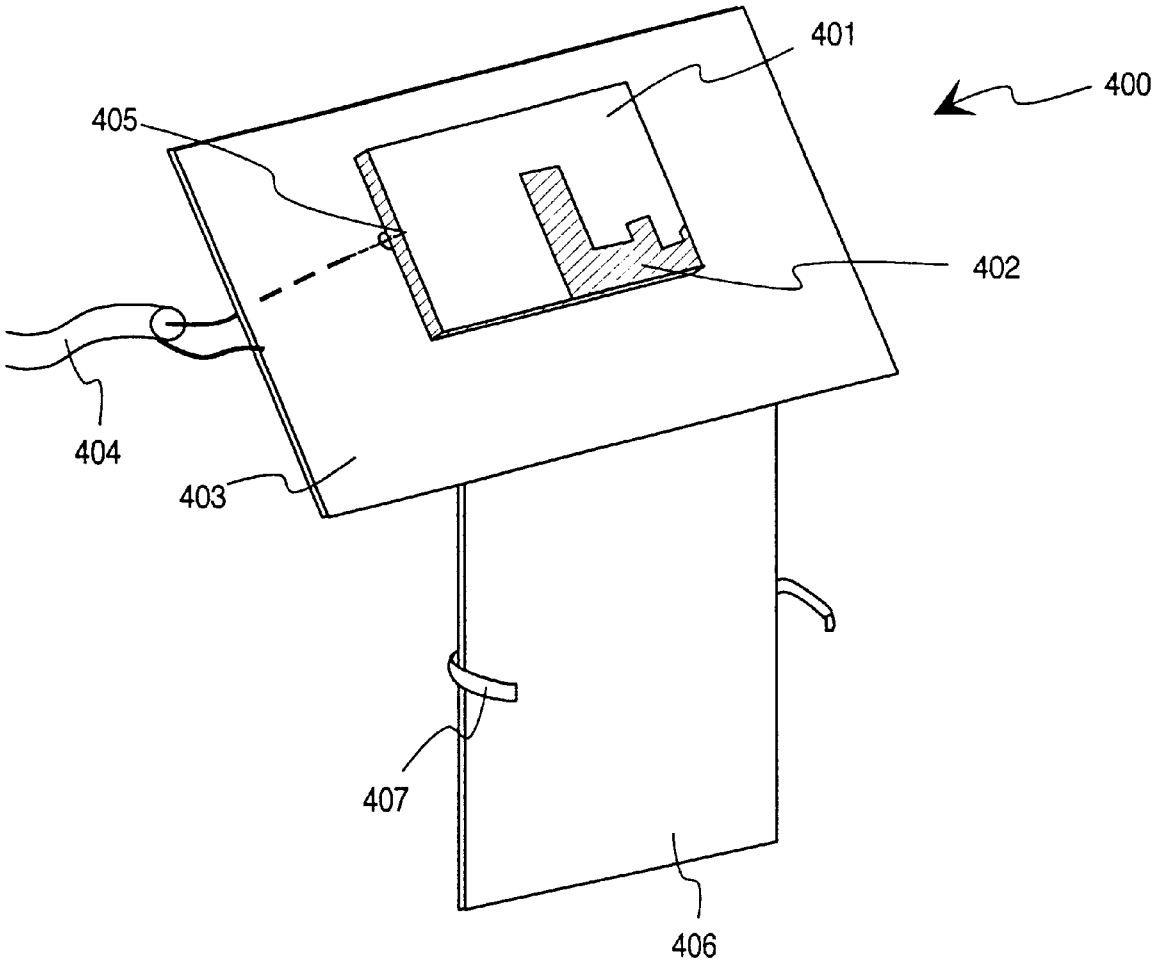
FIG. 4 illustrates a first antenna coupler according to the invention.

In FIG. 4 we see an antenna coupler 400 according to a first advantageous embodiment of the invention. It comprises a planar conductive antenna element 401, which is essentially similar to the planar conductive antenna element 306 in the mobile telephone of FIG. 3*a*. Additionally the antenna coupler comprises a piece of dielectric material 402 for holding the conductive antenna element 401, and a first ground plane 403 which is conductive, essentially continuous and essentially parallel to the conductive antenna element 401. The dielectric piece 402 separates the conductive antenna element 401 from the first ground plane 403. A separate dielectric piece is not necessary if the conductive antenna element 401 can be kept in position in some other way, for example by a thin support frame circulating the edge of the conductive antenna element. The inner conductor of a coaxial cable 404 is connected to the conductive antenna element 401 at a feed point 405. The shield or outer conductor of the coaxial cable 404 is connected to the first ground plane 403. The other end of the coaxial cable 404, which is not seen in FIG. 4, may be connected for example to an external antenna or to a testing arrangement. The invention does not require that a coaxial cable is used to couple the feed point 405 to an external device. For example a testing arrangement may be built in immediate association with the antenna coupler of FIG. 4 so that the antenna coupler 400 forms a part of the outer surface of the testing arrangement and the feed point 405 is connected to a component or a transmission line within the testing arrangement.

The operation of the antenna coupler according to the invention may be enhanced by some additional parts. In FIG. 4 a second conductive ground plane 406 appears at the lower end (with regard to the position shown in FIG. 4 only) of the first ground plane 403 and conductively connected thereto. The size, shape and function of the second ground plane are described in more detail below. Additionally the antenna coupler 400 comprises attaching means 407 for creating a temporary mechanical attachment between the antenna coupler and a mobile telephone that is to be connected thereto. The antenna coupler comprises usually some mechanical parts for providing support and design; these are not shown in FIG. 4 for the sake of graphical clarity.

Figure 5:
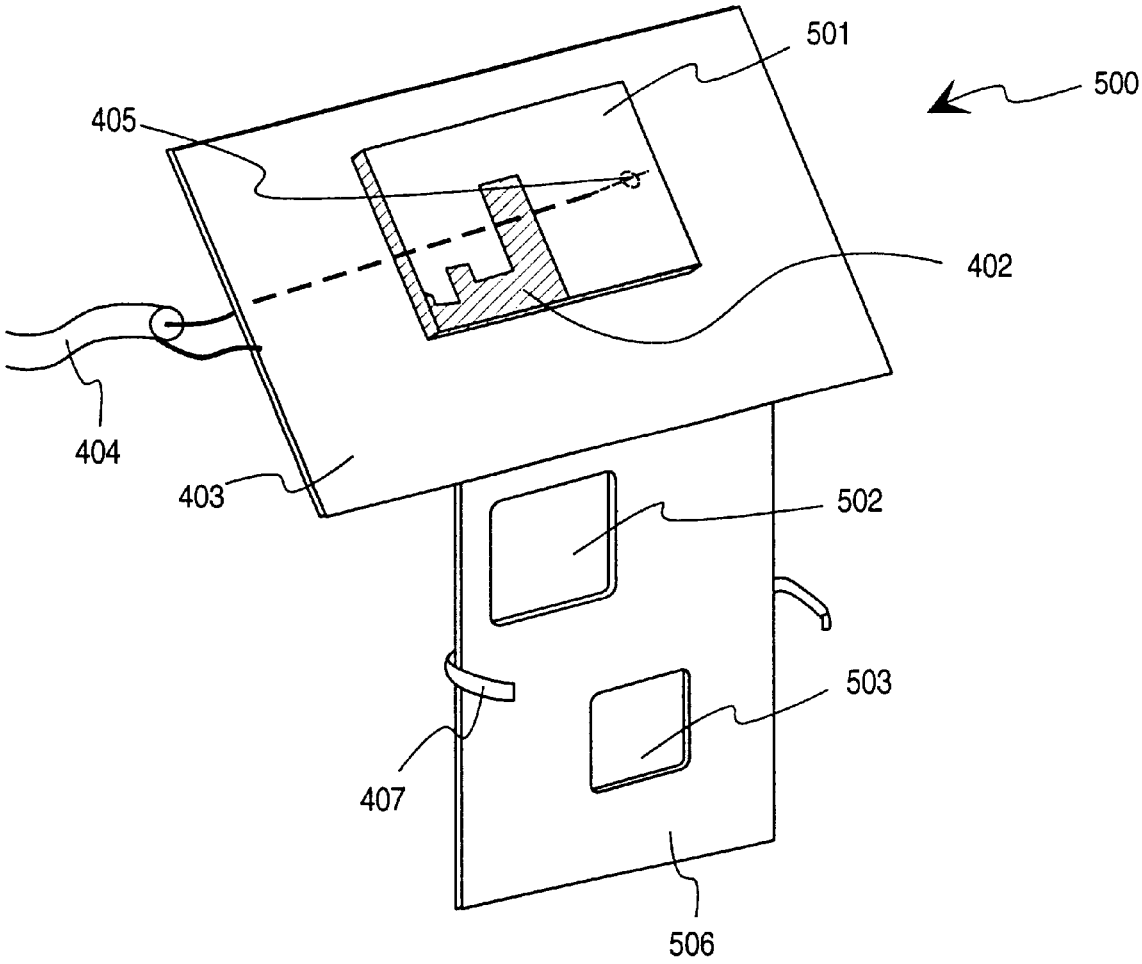
FIG. 5 illustrates a second antenna coupler according to the invention.

FIG. 5 illustrates a second embodiment of an antenna coupler according to the present invention. A comparison between FIGS. 4 and 5 reveals that the only differences between the embodiments are the orientation of the conductive antenna element 501 in FIG. 5 in relation to the conductive antenna element 401 in FIG. 4, and the holes 502 and 503 that exist in the second ground plane 506 in the embodiment of FIG. 5. The second ground plane 406 of FIG. 4 is essentially continuous.

Figure 6:
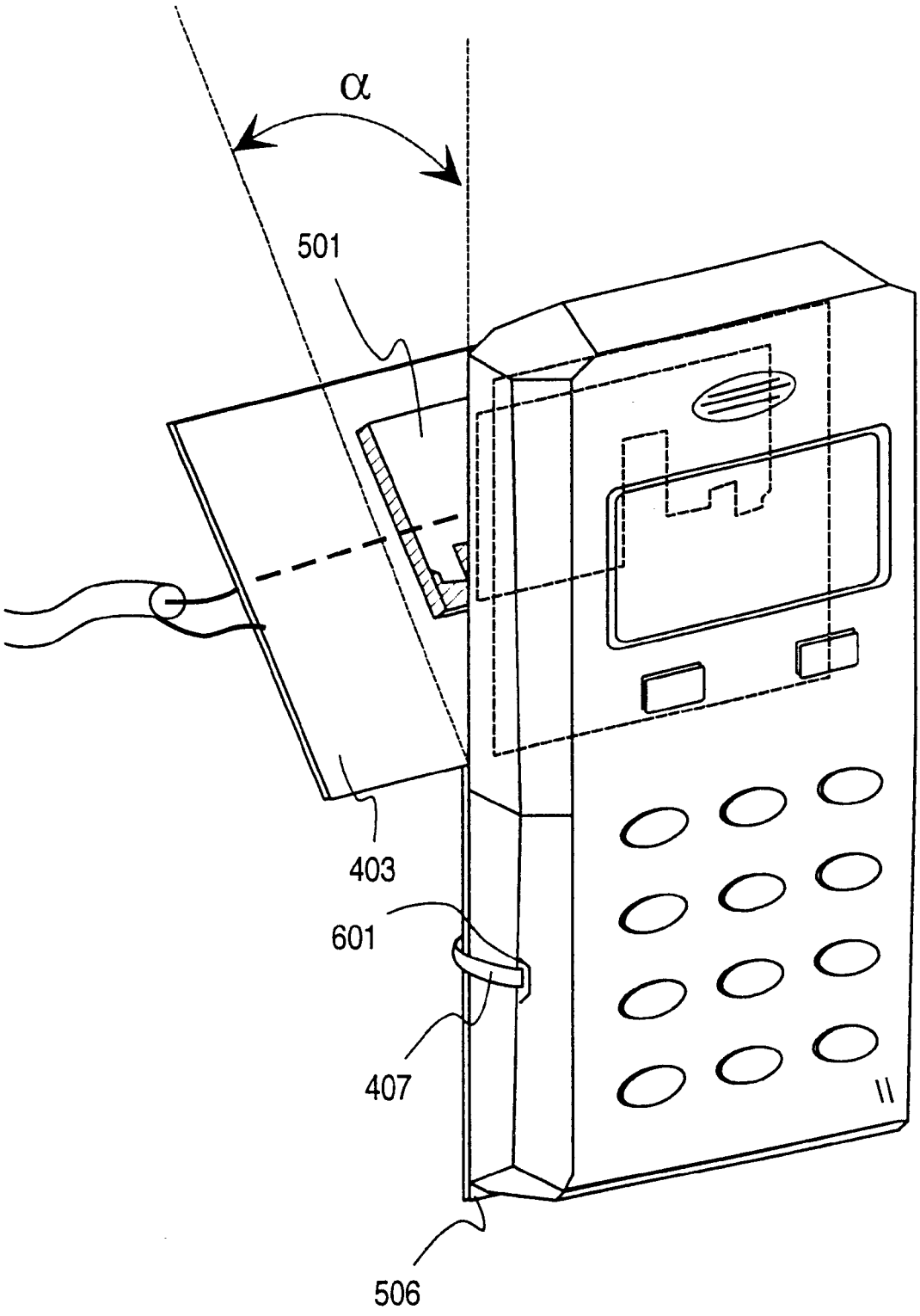
FIG. 6 illustrates the mobile telephone of FIG. 3*a* attached to the antenna coupler of FIG. 5, FIGS. 7*a* and 7*b* visualize the relative positions of some conductive antenna elements.

FIG. 6 shows how the mobile telephone of FIG. 3*a* will be temporarily attached to the antenna coupler of FIG. 5. In the attached position the back plane of the mobile telephone is essentially parallel with the second ground plane 506, and the planar direction of the first ground plane 403 (which is the same as the planar direction of the antenna element 501 in the antenna coupler) defines an angle $\alpha$ with the planar direction of the back plane of the mobile telephone. The attaching means 407 engage with corresponding counterparts 601 in the mobile telephone. A common form of attaching means is a pair of movable, spring-loaded hooks in the antenna coupler and corresponding slots for the ends of the hooks in the mobile telephone. The invention is not sensitive to the kind of attaching means used.

The mobile telephone seen in FIGS. 3 and 6 has a flat, non-curved general outline. For devices with a curved outline it is naturally possible to design the antenna coupler accordingly. For example the second ground plane may basically take any form whatsoever, it it helps to establish a good ground connection.

Figure 7A:
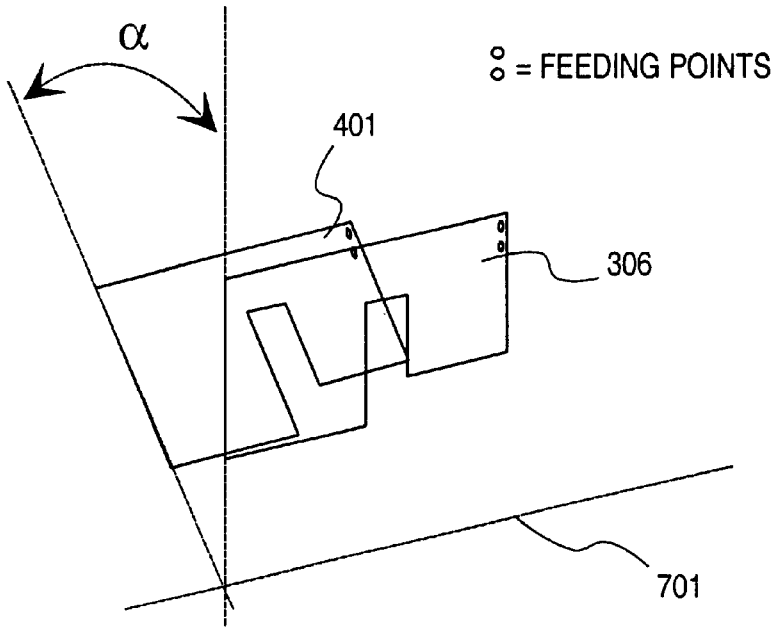
Figure 7B:
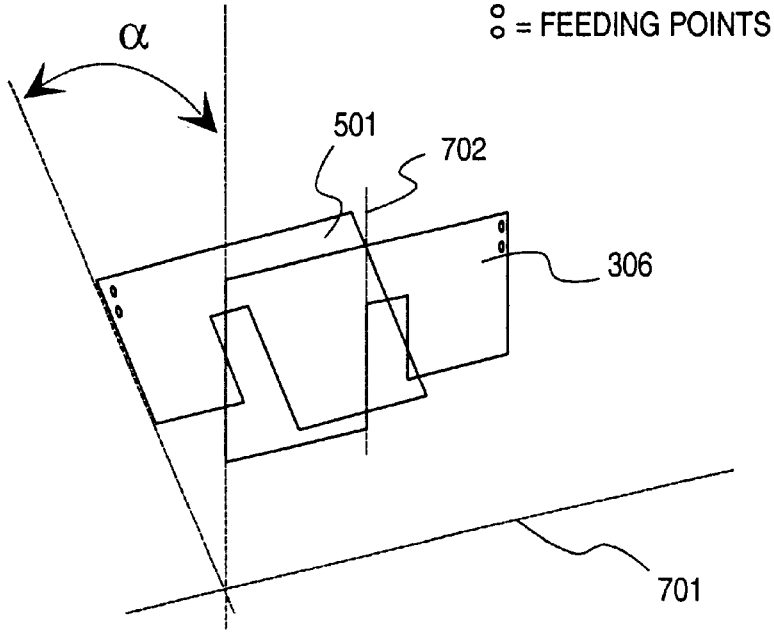

FIGS. 7*a* and 7*b* illustrate the different mutual positioning of the planar conductive antenna element 306 of the mobile telephone and the planar conductive antenna elements 401 or 501 when a mobile telephone is connected to the antenna coupler, depending on which of the embodiments seen in FIGS. 4 and 5 is used as the antenna coupler. FIG. 7*a* shows how the conductive antenna elements 306 and 401 are codirectional, i.e. they appear as two copies of a same body, one of which is tilted by an angle $\alpha$ around an imaginary axis 701 which is horizontal in the position of FIG. 7*a*. In FIG. 7*b* we see how the conductive antenna elements 306 and 401 are in mirrored configuration, i.e. they appear as two copies of a same body, one of which is mirrored about an imaginary centerline 702 which is vertical in the position of FIG. 7*b* and tilted by an angle $\alpha$ around an imaginary axis 701 which is perpendicular to said centerline and horizontal in the position of FIG. 7*b*.

In an experiment it was found that the embodiment of FIGS. 5 and 7*b* has more favourable electromagnetic characteristics than the embodiment of FIGS. 4 and 7*a*. Especially the usable bandwidth is wider and the frequency response throughout the usable bandwidth is flatter, which are both very advantageous features of an antenna coupler.

The second ground plane that appears in both embodiments described above was found to improve the coupling coefficient that describes the relative amount of electromagnetic energy which is transferred from the antenna element of the mobile telephone to the antenna element of the antenna coupler or vice versa when the mobile telephone is connected to the antenna coupler like in FIG. 6. The reason for the improvement in the coupling coefficient is the better ground coupling between the mobile telephone and the antenna coupler. Holes in the second ground plane do not essentially impair this effect, if there is in the mobile telephone a sufficiently large conductive and grounded part that coincides with the remaining intact parts of the second ground plane. Usually the ground plane on the PCB (Printed Circuit Board) of the mobile telephone fulfils this requirement.

The materials of the antenna coupler are not critical to the invention, although their selection should obey some general guidelines. The conductive parts should be as good electrical conductors as possible, so a metal with good electrical conductivity like gold, silver or copper is a good choice. The relatively high price of these materials may lead to the use of some other metals like aluminium, brass or nickel-plated steel in a commercial product. The ground planes may be realized on the surfaces of PCBs and they may be rigid or flexible. The dielectric piece that separates the antenna element from the ground plane should have as low losses on the operational frequency as possible. Suitable dielectric materials are some polymers like tetrafluorethylene (known by the registered trademark Teflon of DuPont), or the same ceramic materials that are used in dielectric radio frequency filters. The mechanical parts of the antenna coupler are most preferably made of some plastic material suitable for injection moulding, like polypropylene or polyethylene.

The dimensioning of the parts of the antenna coupler have a certain effect on both the electromagnetic characteristics of the antenna coupler and its applicability for different purposes. Typical applications for the antenna coupler according to the invention are testbenches to which a mobile telephone is temporarily attached during some stage of manufacture or service, and vehicle kits where the antenna coupler is an integral part of the holder which holds the mobile telephone. In the former kind of applications the physical size of the arrangement is not very important, but the electromagnetic characteristics are of paramount importance. On the contrary, in the latter kind of applications some electromagnetic characteristics may be sacrificed for the sake of small size and compact appearance.

For the electromagnetic characteristics of the antenna coupler to be good, the ground planes should be at least as large as the mobile telephone that is to be connected to the antenna coupler. In FIG. 6 it is seen that the first ground plane is considerably wider in the horizontal direction with regard to the position in the drawing. It was found that the width of the first ground plane has a connection to the usable bandwidth of the antenna coupler: a narrower first ground plane corresponds to a narrower bandwidth and vice versa. The thickness of the dielectric piece, i.e. the separation between the antenna element and the first ground plane also has an effect: increasing its thickness widens the usable bandwidth but weakens (lowers) the coupling coefficient.

The tilt angle $\alpha$ has a profound effect upon the electromagnetic characteristics of the antenna coupler. In an ideal case the tilt angle causes there to be two resonance frequencies in the system composed of the antenna element of the mobile telephone and the antenna element of the antenna coupler, the two resonance frequencies being so close to each other that they appear in the frequency response of the antenna coupler arrangement as a single relatively wide band of usable frequencies. In one experimental arrangement this ideal angle was found to be 37°, but the ideal angle depends on many factors in the overall dimensioning of the arrangement.

The mutual alignment of the mobile telephone and the antenna coupler are also important with respect to the electromagnetic characteristics. Aligning movements may be discussed in three orthogonal directions, of which the first is the up/down direction and the second is the left/right direction, both with regard to the common upright operational position of a mobile telephone. The third direction is perpendicular against the two other directions, which means that in the third direction the mobile telephone and the antenna coupler may be brought closer to or taken further from each other. In the up/down direction, moving the antenna coupler upwards with regard to the mobile telephone generally reduces the usable bandwidth but increases the coupling coefficient, and moving the antenna coupler downwards respectively widens the usable bandwidth but decreases the coupling coefficient. Moving the antenna coupler sideways in either way from the perfect central alignment decreases both the bandwidth and the coupling coefficient. In the third direction it is advantageous to bring the antenna coupler as close to the mobile telephone as possible, because the larger the distance, the narrower the bandwidth and the worse the coupling coefficient.

Not only does the mutual alignment and the tilting angle of the antenna coupler affect the electromagnetic characteristics, but it is also important what kind of materials and in what kind of position are there between the antenna element of the mobile telephone and that of the antenna coupler. In an ideal case there should be as little material between the antenna elements as possible, and the material should exhibit very low losses on the operational frequency, because otherwise the coupling coefficient decreases. In a typical situation there is at least a part of the dielectric outer cover of the mobile telephone, which should be parallel to the antenna element of the mobile telephone. Also other structural arrangements in the mobile telephone and/or the antenna coupler may necessitate the insertion of dielectric layers or bodies between the antenna elements. An angle between such a layer of dielectric material and the antenna element of the mobile telephone tends to reduce the usable bandwidth, although increasing the tilt angle of the antenna element of the antenna coupler more or less compensates for the reduction.

It is clear to the person skilled in the art that for each practical application an optimal combination of ground plane sizes, antenna coupler tilt angle and mutual alignment of the mobile telephone and the antenna coupler is possible to find by just experimenting with the different structural parameters.

Above only one type of planar antenna element has been described. However, it is clear to the person skilled in the art that a large number of differently shaped planar antenna elements are available for application together with the idea of the present invention. For example the books "Handbook of Microstrip Antennas", J. R. James and P. S. Hall (Eds.), Vol. 1, Peter Peregrinus Ltd, Lontoo 1989, and "Analysis, Design, and Measurement of Small and Low-Profile Antennas", K. Hirasawa and M. Haneishi, Artech House, Boston 1992 describe a variety of previously known planar antenna elements.

From the European patent application with serial number 98660065.8 there is known a planar antenna element comprising two feed points and two strip branches for operating on more than one frequency band. Such antenna elements are well suited for use according to the present invention. It is also possible to have in the mobile telephone and the antenna coupler a number of separate antenna elements arranged in pairs so that for each antenna element in the mobile telephone there is a corresponding antenna element in the antenna coupler, whereby for the purposes of location and alignment each pair of mutually corresponding antenna elements must be treated like the single pair of antenna elements described above.

The invention does not restrict the position and width of the operational frequency band of the mobile telephone and the antenna coupler, although it is seen that especially advantageous are the frequency bands reserved for the use of cellular radio networks around 900 MHz and 1800–2000 MHz. Similarly the invention is in no way limited to applications concerning mobile telephones, but other devices that come into question are pagers, cordless telephones, radio-operated positioning devices, Personal Digital Assistant devices with radio-operated functions, portable data terminals for wireless local area networks, radio-controlled toys and models and their controller units and so on.

Figure 8:
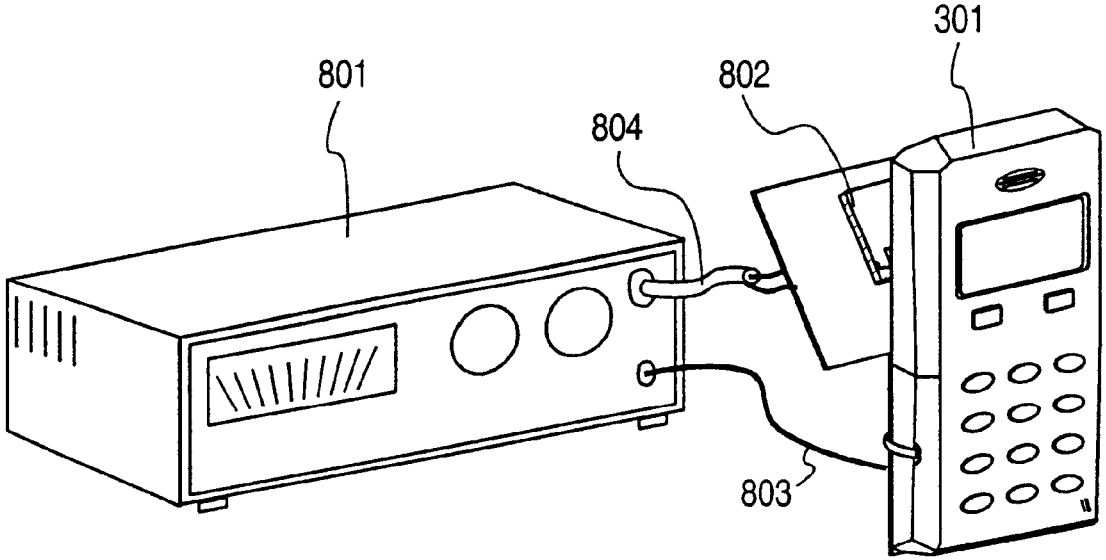
FIG. 8 is a schematic view of an arrangement according to the invention.

FIG. 8 illustrates an arrangement according to an advantageous embodiment of the invention. A mobile telephone 301 is coupled to a testing processor unit 801 through an antenna coupler 802, which in this embodiment is similar to that in FIG. 5. During the test the outer cover of the mobile telephone is open from the side which is against the antenna coupler so that the printed circuit board containing the electronics of the mobile telephone is accessible. The hole(s) in the second ground plane are used for placing a (number of) test connector(s) in touch with suitable contact point(s) and/or receptacle(s) on the mobile telephone's printed circuit board. These test connectors are used to provide the mobile telephone with a suitable operating voltage through a cable 803 during the test. They can also transmit one- or two-way test data between the testing processor unit 801 and the mobile telephone 301 under test. The radio frequency connection 804 couples the testing processor unit 801 to the antenna element of the antenna coupler 802 for transmitting one- or two-way test signals on radio frequency.

At least in a testbench application it is possible to make the angle between the antenna elements adjustable. In such case it is possible to tune the antenna coupler to achieve some required characteristics, e.g. a certain bandwidth.

The coupling coefficient achieved between the antenna element of the mobile telephone and that of the antenna coupler in an experimental arrangement like FIG. 8 was between −1.6 dB and −1.9 dB, which is considerably better than with most prior art solutions.

What is claimed is:

1. Antenna coupler for coupling a radio telecommunication device with an integral planar antenna to an external device, wherein the integral planar antenna of the radio telecommunication device comprises a first planar conductive antenna element, the antenna coupler comprising a second planar conductive antenna element which is essentially similar to the first planar conductive antenna element, a first conductive ground plane parallel to said second planar conductive antenna element and transmission means for conducting a radio frequency signal between said second planar conductive antenna element and the external device.

2. An antenna coupler according to claim 1, further comprising a piece of solid dielectric material between said second planar conductive antenna element and said first conductive ground plane for keeping these together at a predetermined mutual distance.

3. An antenna coupler according to claim 1, wherein said transmission means is a coaxial cable, the inner conductor of which is coupled to said second planar conductive antenna element at a certain feed point and the outer conductor of which is coupled to said first conductive ground plane.

4. An antenna coupler according to claim 1, further comprising a second conductive ground plane attached to one edge of said first conductive ground plane.

5. An antenna coupler according to claim 1, further comprises attaching means for temporarily and removably attaching a radio telecommunication device to the antenna coupler.

6. An antenna coupler according to claim 1, further comprising an integrated vehicle kit holder for the radio telecommunication device.

7. An antenna coupler according to claim 1, further comprising an integrated testbench for holding the telecommunication device during a performance measurement.

8. Arrangement for coupling a radio telecommunication device to an external device, comprising a radio telecommunication device with an integral planar antenna that comprises a first planar conductive antenna element, an external device, an antenna coupler for coupling radio frequency signals between the radio telecommunication device and the external device, within the antenna coupler a second planar conductive antenna element which is essentially similar to the first planar conductive antenna element, within the antenna coupler a first conductive ground plane parallel to said second planar conductive antenna element and transmission means for conducting a radio frequency signal between said second planar conductive antenna element and the external device.

9. An arrangement according to claim 8, wherein the antenna coupler comprises means for temporarily and removably attaching a radio telecommunication device to the antenna coupler in an attachment position in which the planes of the first planar conductive antenna element and the second planar conductive antenna element define an angle that is greater than zero.

10. An arrangement according to claim 9, wherein said angle is essentially 37°.

11. An arrangement according to claim 9, wherein said angle is adjustable.

12. An arrangement according to claim 9, wherein the antenna coupler further comprises a second conductive ground plane whose direction in said attachment position follows the outline of the radio telecommunication device.

13. An arrangement according to claim 12, wherein the second conductive ground plane comprises holes for conducting a cable between the radio telecommunication device and the external device when the radio telecommunication device is in said attachment position.

14. An arrangement according to claim 9, wherein with regard to the first planar conductive antenna element, in said attachment position the second planar conductive antenna element is mirrored about an imaginary centerline of the first planar conductive antenna element and tilted by an angle $\alpha$ around an imaginary axis which is perpendicular to said centerline.

15. An arrangement according to claim 14, wherein the first conductive ground plane reaches significantly further in the direction of said imaginary axis than said radio telecommunication device.

16. An arrangement according to claim 8, wherein said external device is an external antenna.

17. An arrangement according to claim 8, wherein said external device is a testing unit for measuring the performance of the radio telecommunication device.

18. An arrangement according to claim 8, wherein said radio telecommunication device is a mobile telephone.

* * * * *